US008985422B2

(12) United States Patent
Maruhata

(10) Patent No.: US 8,985,422 B2
(45) Date of Patent: Mar. 24, 2015

(54) ACCUMULATING APPARATUS

(75) Inventor: Kazuya Maruhata, Mima-gun (JP)

(73) Assignee: Livedo Corporation, Ehime (JP)

( * ) Notice: Subject to any disclaimer, the term of this patent is extended or adjusted under 35 U.S.C. 154(b) by 525 days.

(21) Appl. No.: 13/312,097

(22) Filed: Dec. 6, 2011

(65) Prior Publication Data

US 2012/0145762 A1 Jun. 14, 2012

(30) Foreign Application Priority Data

Dec. 10, 2010 (JP) ..... P2010-275875

(51) Int. Cl.
*B65H 19/14* (2006.01)
*B65H 20/34* (2006.01)

(52) U.S. Cl.
CPC ..... *B65H 20/34* (2013.01); *B65H 19/14* (2013.01); *B65H 2403/42* (2013.01)
USPC ..... 226/118.3; 242/552; 242/417.2; 242/417.3

(58) Field of Classification Search
CPC ..... B65H 19/14; B65H 20/30; B65H 20/32; B65H 20/34; B65H 2403/42
USPC ..... 226/118.2, 118.3, 4; 242/551, 552, 417, 242/417.1, 417.2, 417.3
See application file for complete search history.

(56) References Cited

U.S. PATENT DOCUMENTS

| | | | |
|---|---|---|---|
| 3,390,843 | A | 7/1968 | Young |
| 3,540,641 | A | 11/1970 | Besnyo |
| 5,163,594 | A | 11/1992 | Meyer |
| 2003/0015619 | A1 | 1/2003 | Tipton et al. |
| 2003/0102398 | A1 | 6/2003 | Nordlof |
| 2010/0276466 | A1 | 11/2010 | Kameda |
| 2011/0062206 | A1 | 3/2011 | Klein et al. |

FOREIGN PATENT DOCUMENTS

| | | |
|---|---|---|
| CN | 1398760 | 2/2003 |
| DE | 198 48 519 | 5/2000 |
| EP | 0 761 582 | 3/1997 |
| EP | 0 989 084 | 3/2000 |
| JP | 55-7810 | 6/1980 |
| JP | 7-137899 | 5/1995 |
| JP | 11-240651 | 9/1999 |
| JP | 2009-132473 | 6/2009 |
| WO | 2009/141072 | 11/2009 |

OTHER PUBLICATIONS

Extended European Search Report issued Apr. 5, 2012 in corresponding European Application No. 11009605.4.
Extended European Search Report (in English language) issued Jan. 24, 2013 in corresponding European Patent Application No. 12 00 7421.

*Primary Examiner* — William E Dondero
(74) *Attorney, Agent, or Firm* — Wenderoth, Lind & Ponack, LLP

(57) ABSTRACT

An accumulating apparatus (4) has an upper arm (51) in which a plurality of upper rollers (511) are arranged, and a lower arm (52) in which a plurality of lower rollers (521) are arranged. An upper gear (61) is fixed to the upper arm and a lower gear (62) is fixed to the lower arm. The upper gear is engaged with the lower gear so that the upper arm and the lower arm are simultaneously moved in opposite directions with respect to a vertical direction. Therefore, when moving the lower arm in the vertical direction, influence of the weight of the lower arm is canceled by the weight of the upper arm, and a force to move the lower arm upward can be reduced. As the result, an air cylinder (63) for changing a distance between the upper arm and the lower arm can be downsized.

5 Claims, 4 Drawing Sheets

ACCUMULATING APPARATUS

BACKGROUND OF THE INVENTION

1. Technical Field

The present invention relates to an accumulating apparatus for accumulating continuous sheet supplied from an upstream apparatus while continuously feeding the continuous sheet to a downstream apparatus.

2. Description of the Related Art

Conventionally, a system where various processes are applied to continuous sheet while the continuous sheet is continuously conveyed to continuously manufacture products such as disposable diapers, is in practical use. In such a system, an accumulating apparatus is provided between an upstream supplying apparatus for drawing continuous sheet from wound sheet where the continuous sheet is wound like a roll (hereinafter the wound sheet is simply referred to as a "wound roll") and a downstream manufacturing apparatus for sequentially applying processes to each portion of the continuous sheet.

In the accumulating apparatus, a plurality of upper rollers are located topside in a vertical direction and a plurality of lower rollers are located downside in the vertical direction. The continuous sheet is held in contact with the upper rollers and the lower rollers alternately to be conveyed, and therefore the continuous sheet supplied from the upstream supplying apparatus is accumulated while being continuously fed to the downstream manufacturing apparatus. When the remaining amount of the continuous sheet in the wound roll becomes low, supply of the continuous sheet from the supplying apparatus is stopped and a distance between the upper rollers and the lower rollers is decreased to keep feeding the continuous sheet to the manufacturing apparatus (see, for example, Japanese Patent Application Laid-Open No. 7-137899). Then, the continuous sheet is cut from the wound roll and spliced to an end of continuous sheet of a new wound roll in the supplying apparatus, and therefore it is possible to switch the wound roll with the low remaining amount to new wound roll, without stopping the downstream manufacturing apparatus.

In the above accumulating apparatus, the distance between the upper rollers and the lower rollers can be changed by moving the upper rollers or the lower rollers in the vertical direction. However, since normally the weights of the rollers are large, a mechanism for moving the rollers in the vertical direction becomes large in size and also manufacturing costs of the accumulating apparatus increase.

SUMMARY OF THE INVENTION

The present invention is intended for an accumulating apparatus for accumulating continuous sheet supplied from an upstream apparatus while continuously feeding the continuous sheet to a downstream apparatus. It is an object of the present invention to downsize or omit a mechanism for changing the distance between the upper rollers and the lower rollers in the accumulating apparatus.

The accumulating apparatus according to the present invention comprises: an upper arm and a lower arm; and a distance changing mechanism for simultaneously moving the upper arm and the lower arm opposite to each other with respect to a vertical direction to change the distance between the upper arm and the lower arm. The upper arm comprises upper rollers arranged along an arm main body and each of the upper rollers is parallel with a horizontal direction. The lower arm comprises lower rollers arranged along an arm main body and each of the lower rollers is parallel with a horizontal direction. The continuous sheet is held in contact with the upper rollers and the lower rollers alternately to repeatedly travel between the upper arm and the lower arm, and the distance changing mechanism comprises: a motion transmitting mechanism mechanically coupling the upper arm with the lower arm to synchronize movement of the upper arm with movement of the lower arm; and an actuator for performing at least one of an action to move the upper arm and the lower arm away from each other and an action to move the upper arm and the lower arm close to each other.

In the present invention, it is possible to downsize the actuator in the accumulating apparatus.

According to a preferred embodiment of the present invention, the upper arm and the lower arm are swung up and down, and the motion transmitting mechanism is a plurality of gears. With this arrangement, the structure of the motion transmitting mechanism can be simplified.

In this case, more preferably, the motion transmitting mechanism comprises: an upper gear fixed to the upper arm; and a lower gear fixed to the lower arm and engaged with the upper gear.

According to another preferred embodiment of the present invention, in a state where the continuous sheet is removed from the upper arm and the lower arm, the upper arm and the lower arm are balanced at constant positions. It is therefore possible to prevent the continuous sheet from being overloaded.

Another accumulating apparatus according to the present invention comprises: an upper arm and a lower arm; and a motion transmitting mechanism mechanically coupling the upper arm with the lower arm, when one arm of the upper arm and the lower arm is moved with respect to a vertical direction, the motion transmitting mechanism simultaneously moves the other arm toward an opposite direction with respect to the vertical direction. The upper arm comprises upper rollers arranged along an arm main body and each of the upper rollers is parallel with a horizontal direction. The lower arm comprises lower rollers arranged along an arm main body and each of the lower rollers is parallel with a horizontal direction. The continuous sheet is held in contact with the upper rollers and the lower rollers alternately to repeatedly travel between the upper arm and the lower arm, and in a state where the continuous sheet is removed from the upper arm and the lower arm, the upper arm and the lower arm are moved away from each other. It is therefore possible to omit an actuator in the accumulating apparatus.

These and other objects, features, aspects and advantages of the present invention will become more apparent from the following detailed description of the present invention when taken in conjunction with the accompanying drawings.

DETAILED DESCRIPTION OF THE INVENTION

Figure 1:
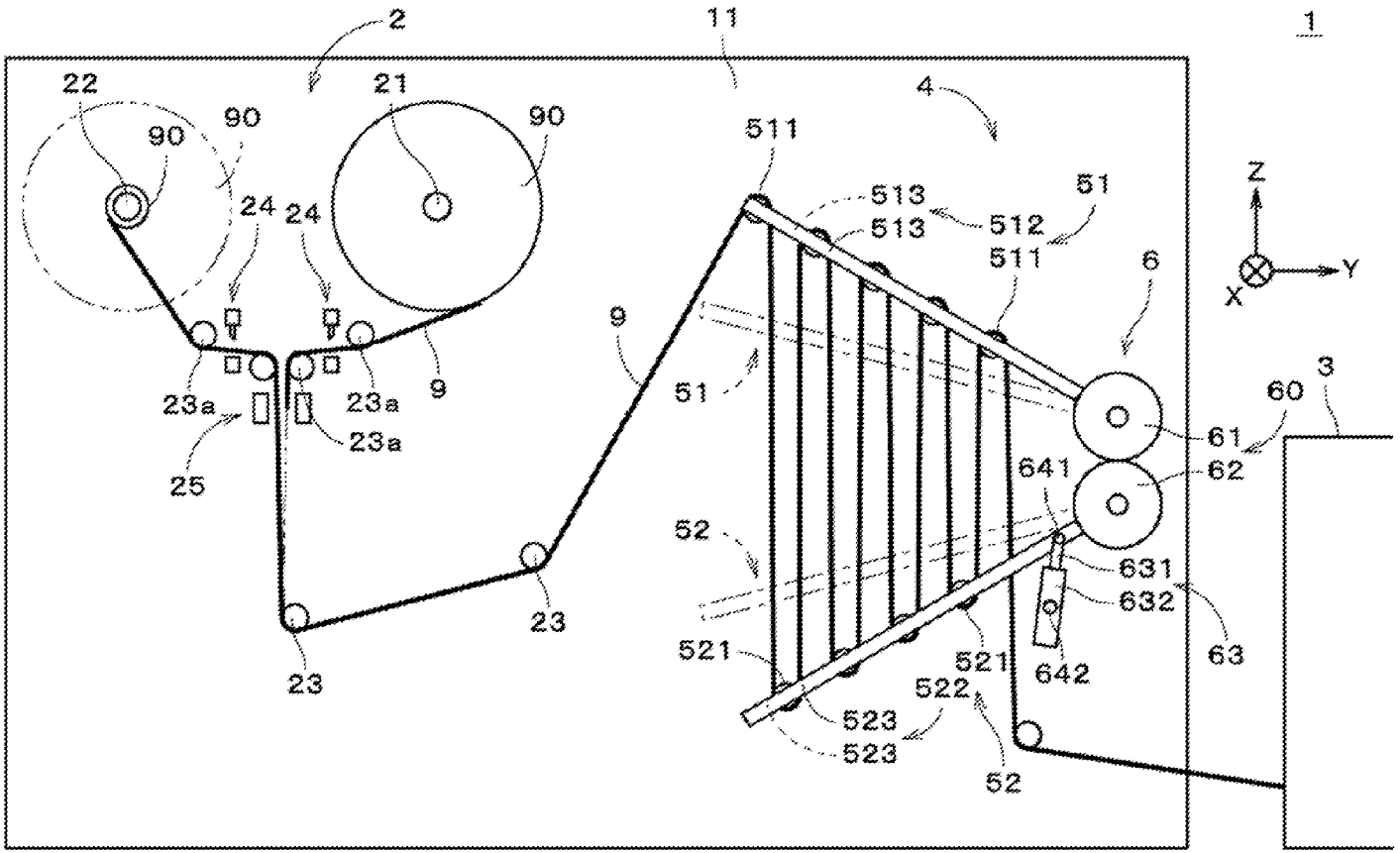
FIG. 1 is a view showing a part of a manufacturing system of absorbent product in accordance with a first preferred embodiment.

FIG. 1 is a view showing a part of a manufacturing system 1 of absorbent product in accordance with a first preferred embodiment of the present invention. The manufacturing system 1 shown in FIG. 1 has a supplying apparatus 2 for drawing continuous sheet 9 from a wound roll 90 where the continuous sheet 9 of nonwoven fabric is wound like a roll, a manufacturing apparatus 3 for sequentially applying processes to each portion of the continuous sheet 9 to manufacture absorbent products (finished products or parts) such as disposable diapers, and an accumulating apparatus 4 (it is also called as an accumulation dancer) located between the supplying apparatus 2 and the manufacturing apparatus 3. The supplying apparatus 2 and the accumulating apparatus 4 are supported by a base part 11. The accumulating apparatus 4 is for accumulating the continuous sheet 9 supplied from the upstream supplying apparatus 2 while continuously feeding the continuous sheet 9 to a downstream manufacturing apparatus 3. In FIG. 1, two horizontal directions orthogonal to each other are shown as the X direction and the Y direction, and a vertical direction (i.e., a direction of gravitational force) orthogonal to the X direction and the Y direction is shown as the Z direction. In FIG. 1, only a part of the manufacturing apparatus 3 is illustrated.

The supplying apparatus 2 has two shaft parts 21, 22 each holding one wound roll 90, and each shaft part 21, 22 parallel with the X direction is rotatably supported by the base part 11. The shaft parts 21, 22 are connected with a motor (not shown), and the wound roll 90 can be rotated together with the shaft parts 21, 22 by driving the motor, to draw the continuous sheet 9 from the wound roll 90. There may be a case where the continuous sheet 9 can be drawn from each wound roll 90 by a rotating belt which is in contact with the continuous sheet 9 or the like.

In the supplying apparatus 2, only the continuous sheet 9 drawn from one wound roll 90 is supplied to the accumulating apparatus 4 through a plurality of rollers 23 that are parallel with the X direction (some rollers are denoted by reference signs 23*a*.). The plurality of rollers 23 are rotatably supported by the base part 11. Hereinafter the wound roll 90 from which the continuous sheet 9 is drawn to be supplied to the accumulating apparatus 4 (in FIG. 1, the left wound roll 90) is referred to as a "current wound roll 90".

Cutting parts 24 are provided between two rollers (in FIG. 1, they are denoted by reference signs 23*a*) located in the vicinities of respective shaft parts 21, 22. In each cutting part 24, cutting of the continuous sheet 9 can be achieved by moving a cutter in the Z direction. An after-mentioned splicing part 25 is provided downstream of the two rollers 23*a* (i.e., on the downstream side in a moving direction of portions of the continuous sheet 9).

The accumulating apparatus 4 has an upper arm 51 located at the upper side ((+Z) side) in the vertical direction, a lower arm 52 located at the lower side ((−Z) side) in the vertical direction, and a distance changing mechanism 6 for changing a distance (i.e., gap distance) between the upper arm 51 and the lower arm 52. The upper arm 51 has a long arm main body 512 and a plurality of upper rollers 511 arranged along the arm main body 512. The arm main body 512 has two supporting rods 513 each extending in a direction orthogonal to the X direction, and the two supporting rods 513 are arranged in the X direction. The plurality of upper rollers 511, parallel with the X direction, are rotatably supported between the two supporting rods 513 parallel with each other. In a similar fashion to the upper arm 51, the lower arm 52 has a long arm main body 522 and a plurality of lower rollers 521 arranged along the arm main body 522, and the plurality of lower rollers 521, parallel with the X direction, are rotatably supported between two supporting rods 523 of the arm main body 522 which are parallel with each other. In the accumulating apparatus 4, the continuous sheet 9 supplied from the upstream supplying part 2 is held in contact with the upper rollers 511 and the lower rollers 521 alternately from the (−Y) side toward the (+Y) direction, to repeatedly travel between the upper arm 51 and the lower arm 52 (i.e., to have multiple turns therebetween) and to be conveyed.

The distance changing mechanism 6 has an upper gear 61 fixed to an end of the arm main body 512 of the upper arm 51 and a lower gear 62 fixed to an end of the arm main body 522 of the lower arm 52. The upper gear 61 and the lower gear 62 are rotatably supported by the base part 11, and the upper arm 51 and the lower arm 52 can be swung up and down in the vertical direction (the Z direction) with respect to the upper gear 61 and the lower gear 62 (around the gears), respectively. The upper gear 61 and the lower gear 62 are engaged with each other, and in the present embodiment, the upper gear 61 and the lower gear 62 have the same shape (i.e., both have the same diameter, the same number of gear teeth and the like). Thus, when the lower arm 52 is rotated clockwise or counterclockwise around the lower gear 62 by a predetermined angle, the upper arm 51 is rotated counterclockwise or clockwise around the upper gear 61 by the same angle. In other words, the upper arm 51 and the lower arm 52 are simultaneously moved by the same distance in opposite directions with respect to the vertical direction. With respect to each position in the Y direction, the upper arm 51 and the lower arm 52 are moved simultaneously by the same distance toward respective directions opposite to each other.

As above, in the distance changing mechanism 6 shown in FIG. 1, the upper gear 61 and the lower gear 62, which function as a motion transmitting mechanism 60, mechanically couple the upper arm 51 with the lower arm 52 to synchronize movement of the upper arm 51 with movement of the lower arm 52. In the present embodiment, the upper gear 61 and the lower gear 62 have the same shape, the amount of torque exerted by the weight of the upper arm 51 on the upper gear 61 is almost equal to the amount of torque the weight of the lower arm 52 exerts on the lower gear 62, and therefore if supposing a state where the continuous sheet 9 is removed from the upper arm 51 and the lower arm 52, the upper arm 51 and the lower arm 52 are balanced at constant positions (exactly, tangential forces between the upper gear 61 and the lower gear 62 are balanced and positions of the both arms are not changed).

The distance changing mechanism 6 further has an air cylinder 63, and an end of a piston part 631 of the air cylinder 63 is rotatably attached, through a pin 641, to a portion of the arm main body 522 in the lower arm 52 which is positioned in the vicinity of the lower gear 62. Also a main body part (cylinder part) 632 of the air cylinder 63 is rotatably supported through a pin 642 by the base part 11. With the above structure, the air cylinder 63, which is an actuator, can perform an action to move the upper arm 51 and the lower arm 52 away from each other and an action to move the upper arm 51 and the lower arm 52 close to each other (i.e., it can perform an action to distance the arms from each other and an action to bring the arms close to each other). The actuator may be another fluid cylinder for moving a piston part by another kind of fluid (for example, oil) other than air.

Figure 2:
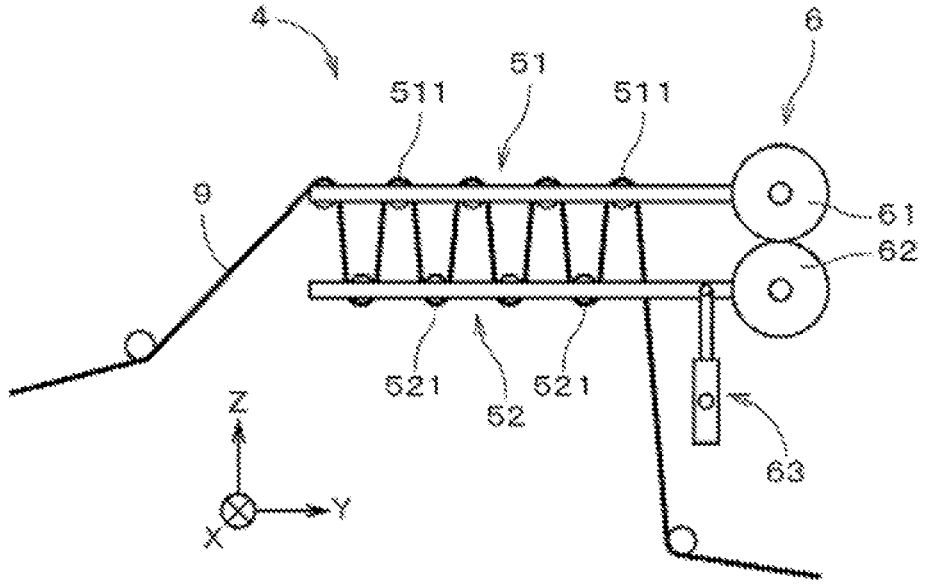
FIG. 2 is a view showing an accumulating apparatus in normal operation.

In normal operation of the accumulating apparatus 4, in a state where the upper arm 51 and the lower arm 52 are close to each other in the Z direction as shown in FIG. 2, the continuous sheet 9 supplied from the supplying apparatus 2 located upstream is continuously fed to the downstream manufacturing apparatus 3 (see FIG. 1). In fact, the continuous sheet 9 is conveyed at a constant conveying speed in the manufacturing apparatus 3, and a supplying speed (i.e., a length of the continuous sheet 9 supplied per unit time) of the continuous sheet 9 is appropriately controlled in the supplying apparatus 2 so that a tension of the continuous sheet 9 positioned in the manufacturing apparatus 3 is kept constant.

When the remaining amount of the continuous sheet 9 in the current wound roll 90 becomes low, the lower arm 52 is gradually moved downward (toward the (−Z) direction) by the air cylinder 63 as shown in FIG. 2. The upper arm 51 is simultaneously moved in a direction that is opposite to the moving direction of the lower arm 52 (i.e., upward) by the upper gear 61 and the lower gear 62 which are engaged (meshed) with each other, and with respect to the Z direction, the distance between the upper arm 51 and the lower arm 52 (the distance between the upper rollers 511 and the lower rollers 521) increases. Therefore, the upper arm 51 and the lower arm 52 are located at positions shown in FIG. 1 where both are away from each other. At this time, since the supplying speed of the continuous sheet 9 is temporarily increased than that in the normal operation in the supplying apparatus 2, the feeding speed of the continuous sheet 9 to the downstream manufacturing apparatus 3 and the tension (tensile force) of the continuous sheet 9 are kept constant in the accumulating apparatus 4 while the upper arm 51 and the lower arm 52 are moved away from each other.

Subsequently, the supplying apparatus 2 of FIG. 1 stops supplying the continuous sheet 9 from the current wound roll 90 (the left wound roll 90 in FIG. 1). Also, the lower arm 52 is gradually moved upward (toward the (+Z) direction) by the air cylinder 63, and with this, the upper arm 51 is moved downward to gradually decrease the distance between the upper arm 51 and the lower arm 52 as shown by the double-dashed lines in FIG. 1. Therefore, the feeding speed of the continuous sheet 9 to the downstream manufacturing apparatus 3 and the tension of the continuous sheet 9 are kept constant in the accumulating apparatus 4.

In the supplying apparatus 2, an end of continuous sheet 9 in the other wound roll 90 (the right wound roll 90 in FIG. 1) is led to the splicing part 25, and the end of the continuous sheet 9 is spliced (joined) onto continuous sheet 9 of the current wound roll 90 with kraft adhesive tape or the like in the splicing part 25 while stopping supplying the continuous sheet 9 from the current wound roll 90. And the continuous sheet 9 is cut off from the current wound roll 90 by the cutting part 24 near the current wound roll 90, and the current wound roll 90 from which continuous sheet 9 is drawn is switched to the right wound roll 90 in FIG. 1. The process where the current continuous sheet 9 is spliced to the continuous sheet 9 of another wound roll 90 while stopping movement of the current continuous sheet 9, is referred to as zero-splice. The splicing of the continuous sheets 9 may be performed by another technique such as heat bonding. A product manufactured with the spliced portion (i.e., a portion on which the kraft adhesive tape is attached) in the manufacturing apparatus 3 is discarded.

In the accumulating apparatus 4, after completion of switching of the current wound roll 90, the upper arm 51 and the lower arm 52 reach positions in the normal operation shown in FIG. 2. At almost the same time, movement of the upper arm 51 and the lower arm 52 is stopped and the supplying apparatus 2 of FIG. 1 starts (restarts) to supply the continuous sheet 9 from the current wound roll 90.

The wound roll 90 cut by the cutting part 24 (i.e., the wound roll 90 where the remaining amount of the continuous sheet 9 is low) is replaced with a new wound roll 90 (shown by the double-dashed line in FIG. 1). When the remaining amount of the continuous sheet 9 in the current wound roll 90 becomes low, the above process is performed to switch the current wound roll 90 while continuously feeding the continuous sheet 9 to the manufacturing apparatus 3. In the normal operation, the upper arm 51 and the lower arm 52 may be located at the positions shown in FIG. 1 where both are away from each other.

Figure 3:
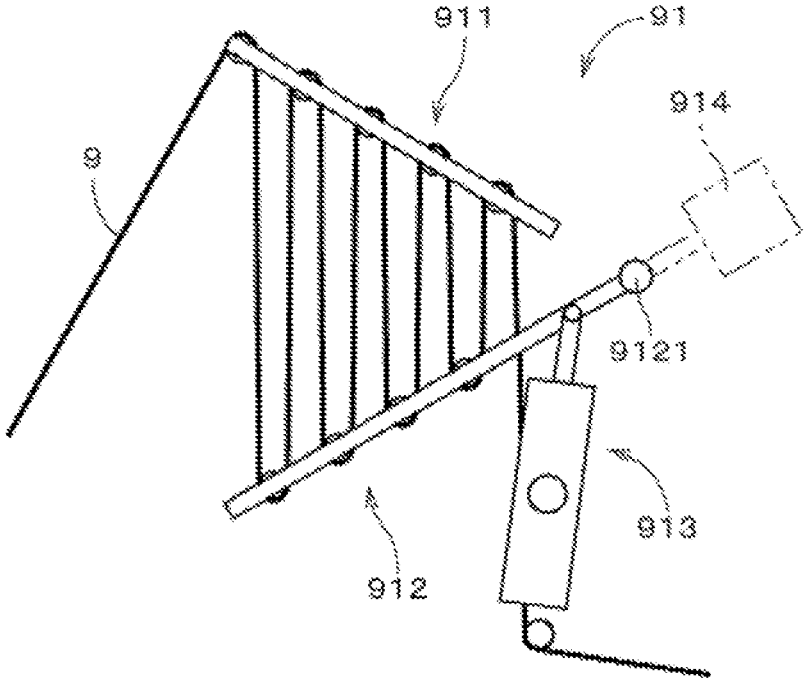
FIG. 3 (PRIOR ART)
FIG. 3 is a view showing an accumulating apparatus of comparative example.

FIG. 3 is a view showing an accumulating apparatus 91 of comparative example. In the accumulating apparatus 91 of comparative example, structure of an upper arm 911 and a lower arm 912 is same as that of the upper arm 51 and the lower arm 52 of FIG. 1, however the upper arm 911 is fixed on a base part and an end 9121 of the lower arm 912 is rotatably supported by the base part. In the accumulating apparatus 91 of a comparative example, when decreasing a distance between the upper arm 911 and the lower arm 912, the lower arm 912 is moved (rotated) upward by an air cylinder 913. However, since the weight of the lower arm 912 having a plurality of rollers is large, it is necessary to use the air cylinder 913 whose bore diameter or the like is large, thereby increasing the manufacturing cost of the accumulating apparatus 91. When increasing the distance between the upper arm 911 and the lower arm 912, it is thought that the lower arm 52 is moved downward by its own weight. However, in this case, the continuous sheet 9 is overloaded (applied with an excessive load). As shown by the double-dashed lines in FIG. 3, by providing a weight 914 to a supporting point of the lower arm 912 so as to be opposite to the lower arm 912, influence of the weight of the lower arm 912 can be reduced in movement of the lower arm 912 in the up-down direction. However, in this case, the accumulating apparatus 91 becomes large in size.

Correspondingly, in the accumulating apparatus 4 shown in FIG. 1, since the upper gear 61 and the lower gear 62 are engaged with each other, it is possible to simultaneously move the upper arm 51 and the lower arm 52 opposite to each other with respect to the vertical direction. Therefore, when moving the lower arm 52 in the vertical direction, influence of the weight of the lower arm 52 is canceled (decreased) by the weight of the upper arm 51. Thus, the force necessary to move the lower arm 52 upward can be reduced without providing the large weight 914 like the accumulating apparatus 91 of the comparative example. As a result, the air cylinder 63 for changing the distance between the upper arm 51 and the lower arm 52 can be downsized and the manufacturing cost of the accumulating apparatus 4 can be reduced. Also the weight of the lower arm 52 does not apply an excessively large load to the continuous sheet 9 unlike the case of the comparative example.

In a state of the accumulating apparatus 4 where the continuous sheet 9 is removed from the upper arm 51 and the lower arm 52, the upper arm 51 and the lower arm 52 are balanced at constant positions, and therefore the continuous sheet 9 can be further prevented from being overloaded by the weight of the lower arm 52. In addition, since the distance between the upper arm 51 and the lower arm 52 can be changed by a smaller force, the air cylinder 63 can be further downsized. Even if the continuous sheet 9 is removed from the accumulating apparatus 4 for maintenance, both arms can be positioned (stay) at desired positions.

Figure 4:
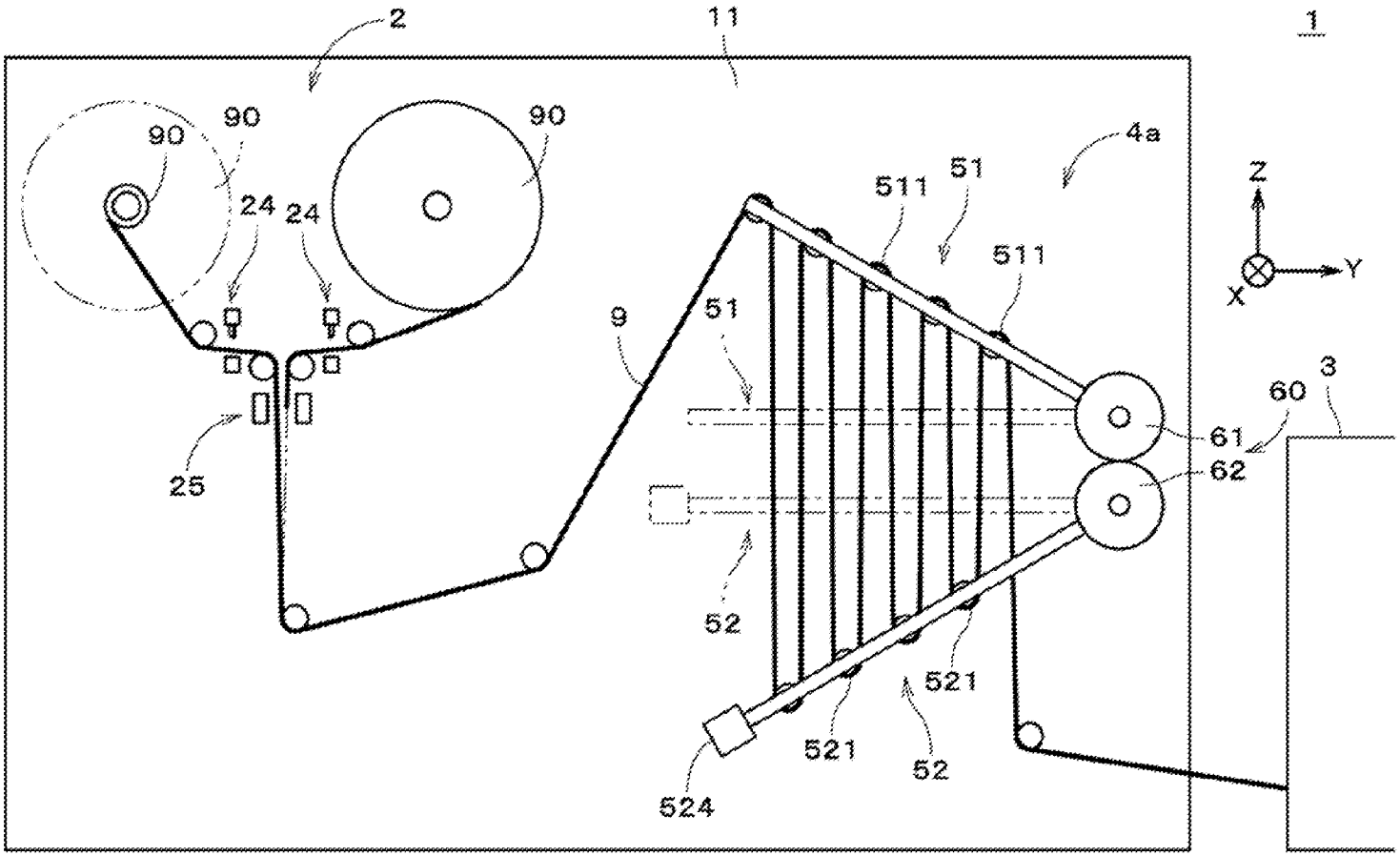
FIG. 4 is a view showing an accumulating apparatus in accordance with a second preferred embodiment.

FIG. 4 is a view showing an accumulating apparatus 4*a* in accordance with a second preferred embodiment of the present invention. In the accumulating apparatus 4*a* shown in FIG. 4, the air cylinder 63 in the accumulating apparatus 4 of FIG. 1 is omitted and a small weight 524 is provided to the lower arm 52. The other constituent parts of the accumulating apparatus 4*a* are the same as those of the accumulating apparatus 4 shown in FIG. 1, and parts corresponding to respective parts of the accumulating apparatus 4 are denoted by the same reference signs.

In the accumulating apparatus 4*a*, the upper gear 61 and the lower gear 62 have the same shape, and the amount of torque exerted on the lower gear 62 by the weight of the lower arm 52 is larger than the amount of torque exerted on the upper gear 61 by the weight of the upper arm 51. Thus, in a state where the continuous sheet 9 has just been removed from the upper arm 51 and the lower arm 52 (i.e., in a period from the time when the continuous sheet 9 is removed to the time when movement of the arms is stopped), the lower arm 52 is moved downward (i.e., toward the (−Z) direction) with respect to the vertical direction and the upper arm 51 is moved upward.

In normal operation of the accumulating apparatus 4*a*, the continuous sheet 9 supplied from the upstream supplying apparatus 2 is continuously fed to the downstream manufacturing apparatus 3 in a state where the upper arm 51 and the lower arm 52 are close to each other as shown by double-dashed lines in FIG. 4. At this time, since the supplying speed of the continuous sheet 9 by the supplying apparatus 2 is equal to a feeding speed of the continuous sheet 9 toward the manufacturing apparatus 3, the upper arm 51 and the lower arm 52 in the accumulating apparatus 4*a* are almost maintained at the positions shown by the double-dashed lines in FIG. 4. In other words, the upper arm 51 and the lower arm 52 are held at the above positions by the continuous sheet 9.

When a remaining amount of the continuous sheet 9 in the current wound roll 90 located left in FIG. 4 becomes low, the supplying speed of the continuous sheet 9 in the supplying apparatus 2 is temporarily made higher than that in the normal operation. Therefore, an amount (length) of the continuous sheet 9 supplied to the accumulating apparatus 4*a* per unit time increases, the lower arm 52 is moved downward in the vertical direction by the own weight of the lower arm 52, and this is accompanied by upward movement of the upper arm 51. Thus, in the accumulating apparatus 4*a*, the upper arm 51 and the lower arm 52 are located at positions away from each other as shown in FIG. 4 (the positions are shown by solid lines.) while the feeding speed of the continuous sheet 9 to the downstream manufacturing apparatus 3 is kept constant.

Subsequently, the supplying apparatus 2 stops supplying the continuous sheet 9 from the current wound roll 90. The manufacturing apparatus 3 keeps drawing the continuous sheet 9 accumulated between the upper arm 51 and the lower arm 52 in the accumulating apparatus 4*a*, and with this, a distance between the upper arm 51 and the lower arm 52 gradually decreases. As above, in the accumulating apparatus 4*a*, supply of the continuous sheet 9 from the upstream supplying apparatus 2 is stopped while the feeding speed of the continuous sheet 9 to the downstream manufacturing apparatus 3 is kept constant. In a period when the supplying apparatus 2 stops supplying the continuous sheet 9, current wound roll 90 from which continuous sheet 9 is drawn is switched to the right wound roll 90 in FIG. 4, in a similar fashion to the above first preferred embodiment.

After completion of switching of current wound roll 90, at almost the same time when the upper arm 51 and the lower arm 52 reach the positions in the normal operation shown by the chain double-dashed lines in FIG. 4, supply of the continuous sheet 9 from the current wound roll 90 is started by the supplying apparatus 2. Therefore, movement of the upper arm 51 and the lower arm 52 is stopped, and the upper arm 51 and the lower arm 52 keep the positions in the normal operation.

As described above, in the accumulating apparatus 4*a* shown in FIG. 4, by engaging the upper gear 61 fixed to the upper arm 51 with the lower gear 62 fixed to the lower arm 52, a motion transmitting mechanism 60 is constructed. When one arm of the upper arm 51 and the lower arm 52 is moved with respect to the vertical direction, the motion transmitting mechanism 60 simultaneously moves the other arm toward an opposite direction with respect to the vertical direction. In addition, the amount of torque exerted on the lower gear 62 by the weight of the lower arm 52 is lager than the amount of torque exerted on the upper gear 61 by the weight of the upper arm 51, and therefore in a state where the continuous sheet 9 is removed from the upper arm 51 and the lower arm 52, the upper arm 51 and the lower arm 52 are moved away from each other (i.e., moved toward directions away from each other). Thus, by controlling the supplying speed of the continuous sheet 9 in the supplying apparatus 2, the distance between the upper arm 51 and the lower arm 52 can be changed without providing the air cylinder 63 of the accumulating apparatus 4 in FIG. 1. As the result, the feeding speed of the continuous sheet 9 can be kept constant for a period when supply of the continuous sheet 9 is stopped, while the air cylinder 63 is omitted. Since the weight 524 is small to be able to swing the arm by a small force, the continuous sheet 9 is prevented from being applied with an excessively large tension by the motion transmitting mechanism 60 and the weight 524.

Though the preferred embodiments of the present invention have been discussed above, the present invention is not limited to the above-discussed preferred embodiments, but allows various variations.

In the above first and second preferred embodiments, the supplying apparatus 2 does not necessarily stop supplying the continuous sheet 9 when switching the current wound roll 90. Switching of current wound roll 90 may be performed while a speed of conveying the continuous sheet 9 in the supplying apparatus 2 (the speed is a supplying speed.) is made lower than a speed in normal operation. In the accumulating apparatus 4, 4*a*, even if the supplying speed of the continuous sheet 9 from the supplying apparatus 2 becomes lower than that in normal operation, the feeding speed of the continuous sheet 9 can be kept constant (i.e., can be maintained at the same speed as the normal operation) by gradually bringing the upper arm 51 and the lower arm 52, which are away from each other, close to each other.

In the accumulating apparatus 4, 4*a* shown in FIGS. 1 and 4, since the motion transmitting mechanism 60 is implemented by the upper gear 61 and the lower gear 62, structure of the motion transmitting mechanism 60 can be simplified. However, the upper gear 61 and the lower gear 62 may be mechanically coupled with each other through another gear(s) (in other words, the upper gear 61 and the lower gear 62 may be engaged with each other indirectly.). Since the motion transmitting mechanism is achieved by a plurality of gears (toothed gears), the structure of the motion transmitting mechanism can be simplified. Shapes of the plurality of gears (diameter, the number of gear teeth and so on) may be different from each other. The weight 524 in FIG. 4 may be omitted by making the number of gear teeth of the lower gear 62 lower than the number of gear teeth of the upper gear 61 (by making a diameter of the lower gear 62 smaller than a diameter of the upper gear 61).

Figure 5:
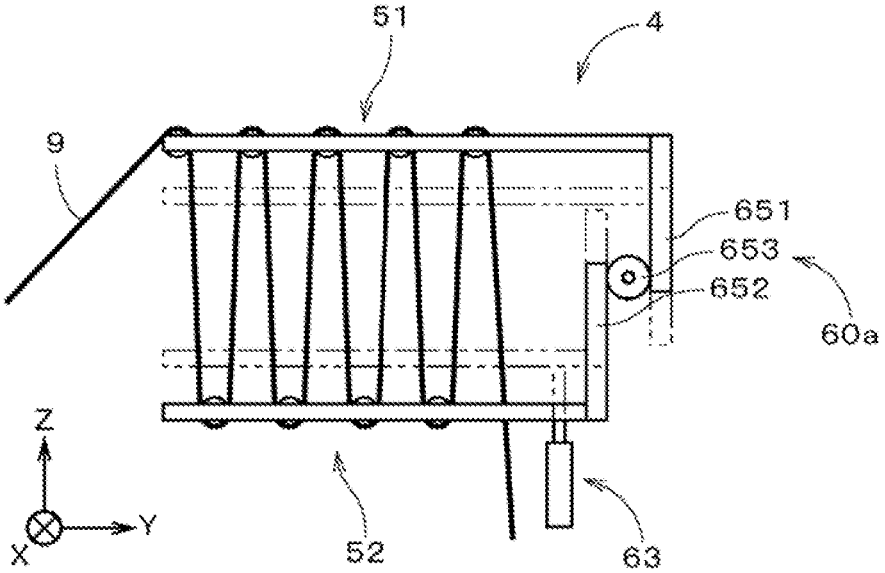
FIG. 5 is a view showing another example of an accumulating apparatus.

As shown in FIG. 5, there may be a case where a rack 651 extending in the Z direction is fixed to a (+Y) side end portion of the upper arm 51, a rack 652 extending in the Z direction is fixed to a (+Y) side end portion of the lower arm 52, and a gear (pinion) 653 engaged with the both rack 651 and rack 652 is provided between the both racks 651, 652 to construct a motion transmitting mechanism 60*a* which can simultaneously move the upper arm 51 and the lower arm 52 opposite to each other with respect to the vertical direction (Z direction). Actually, a guide to guide movement of each rack 651, 652 is provided.

Figure 6:
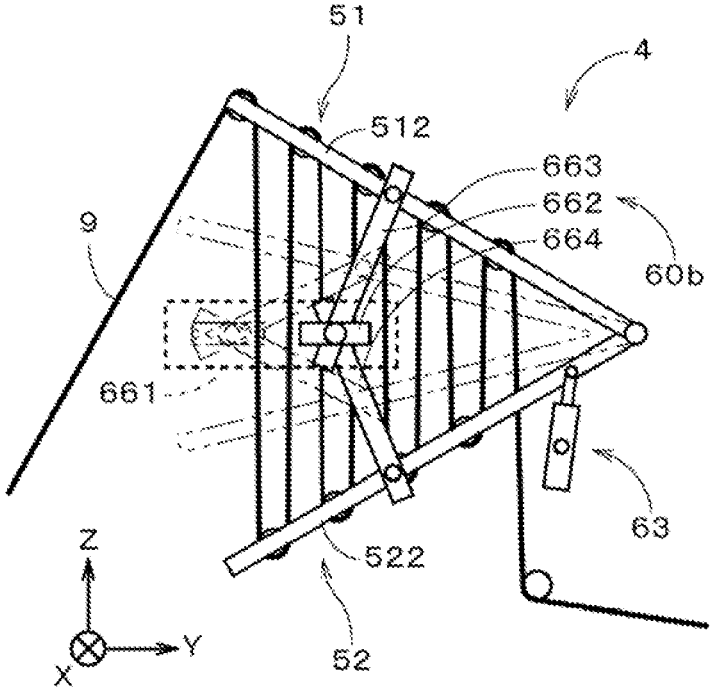
FIG. 6 is a view showing still another example of an accumulating apparatus.

Furthermore, as shown in FIG. 6, there may be a case where a slider 662 supported by a guide 661 (only an outer shape is drawn by broken lines in FIG. 6.) movably in the Y direction is provided and link members 663, 664 in each of which one end is rotatably coupled with the slider 662 and the other end is rotatably coupled with an approximately middle portion of arm main body 512, 522 are provided, to achieve a motion transmitting mechanism 60*b* for synchronizing movement of the upper arm 51 with movement of the lower arm 52.

As above, when one arm of the upper arm 51 and the lower arm 52 is moved with respect to the vertical direction, a motion transmitting mechanism simultaneously moves the other arm toward an opposite direction with respect to the vertical direction (i.e., synchronizes movement of the upper arm 51 with movement of the lower arm 52) by mechanically coupling the upper arm 51 with the lower arm 52, and such a motion transmitting mechanism may be implemented by combination of various mechanical elements such as gear, rack, link mechanism, chain, belt (the same applies to the accumulating apparatus 4*a* shown in FIG. 4.).

In the accumulating apparatus 4 of FIG. 1 having the air cylinder 63, the amount of torque exerted on the upper gear 61 by the weight of the upper arm 51 may be made lager than the amount of torque exerted on the lower gear 62 by the weight of the lower arm 52 (in the motion transmitting mechanism 60*a* shown in FIG. 5, the weight of the upper arm 51 is made larger than the weight of the lower arm 52.). In this case, the upper arm 51 and the lower arm 52 can be brought close to each other without using the air cylinder 63 (note that a spacer is provided between the upper arm 51 and the lower arm 52 to keep their positions in normal operation.), and the air cylinder 63 performs an action to move the upper arm 51 and the lower arm 52 away from each other. On the other hand, the amount of torque exerted on the lower gear 62 by the weight of the lower arm 52 may be made lager than the amount of torque exerted on the upper gear 61 by the weight of the upper arm 51 (in the motion transmitting mechanism 60*a* shown in FIG. 5, the weight of the lower arm 52 is made larger than the weight of the upper arm 51.). In this case, by increase of the supplying speed of the continuous sheet 9 in the supplying apparatus 2, the upper arm 51 and the lower arm 52 can be brought away from each other without using the air cylinder 63, and the air cylinder 63 performs an action to move the upper arm 51 and the lower arm 52 close to each other. As above, the air cylinder 63 which is an actuator has only to perform at least one of an action to move the upper arm 51 and the lower arm 52 away from each other and an action to move the upper arm 51 and the lower arm 52 close to each other.

In a certain design of the accumulating apparatus 4, 4*a*, an actuator may be implemented by a driving mechanism having a motor, a solenoid or the like.

It is only necessary that the number of rollers (upper rollers 511 or lower rollers 521) provided in each of the upper arm 51 and the lower arm 52 is two or more, and therefore the accumulating apparatus 4, 4*a* can accumulate a sufficient length of the continuous sheet 9.

The accumulating apparatus 4, 4*a* for accumulating continuous sheet supplied from an upstream apparatus while continuously feeding the continuous sheet to a downstream apparatus may be used for various applications treating continuous sheet (it may be formed of material other than nonwoven fabric), other than manufacturing of absorbent product with use of the continuous sheet 9 of nonwoven fabric.

The constituent elements of above-discussed preferred embodiments and modified examples may be appropriately combined with one another, as long as they are not mutually exclusive.

While the invention has been shown and described in detail, the foregoing description is in all aspects illustrative and not restrictive. It is therefore understood that numerous modifications and variations can be devised without departing from the scope of the invention. This application claims priority benefit under 35 U.S.C. Section 119 of Japanese Patent Application No. 2010-275875 filed in the Japan Patent Office on Dec. 10, 2010, the entire disclosure of which is incorporated herein by reference.

REFERENCE SIGNS LIST

2 supplying apparatus
3 manufacturing apparatus
4, 4*a* accumulating apparatus
6 distance changing mechanism
9 continuous sheet
51 upper arm
52 lower arm
60, 60*a*, 60*b* motion transmitting mechanism
61 upper gear
62 lower gear
63 air cylinder
511 upper roller
512, 522 arm main body
521 lower roller

The invention claimed is:

1. A manufacturing system of absorbent product, comprising:

a supplying apparatus for drawing continuous sheet from a wound roll;

a manufacturing apparatus for sequentially applying processes to each portion of said continuous sheet to manufacture absorbent products; and an accumulating apparatus for accumulating said continuous sheet supplied from said supplying apparatus while continuously feeding said continuous sheet to said manufacturing apparatus, said supplying apparatus being located upstream of said accumulating apparatus, and said manufacturing apparatus being located downstream of said accumulating apparatus;

wherein said accumulating apparatus comprises:

an upper arm and a lower arm; and a motion transmitting mechanism mechanically coupling said upper arm with said lower arm, such that when one arm of said upper arm and said lower arm is moved with respect to a vertical direction, said motion transmitting mechanism simultaneously moves the other arm in an opposite direction; wherein said upper arm comprises upper rollers arranged along an arm main body and each of said upper rollers is parallel with a horizontal direction, said lower arm comprises lower rollers arranged along an arm main body and each of said lower rollers is parallel with a horizontal direction, said continuous sheet is held in contact with said upper rollers and said lower rollers alternately to repeatedly travel between said upper arm and said lower arm, and a distance between said upper arm and said lower arm is changed by controlling a supplying speed of said continuous sheet in said supplying apparatus.

2. The manufacturing system of absorbent product according to claim 1, wherein said upper arm and said lower arm can be swung up and down, and said motion transmitting mechanism is a plurality of gears.

3. The manufacturing system of absorbent product according to claim 2, wherein said motion transmitting mechanism comprises:

an upper gear fixed to said upper arm; and a lower gear fixed to said lower arm and engaged with said upper gear.

4. The manufacturing system of absorbent product according to claim 3, further comprising a weight connected to said lower arm so that a torque on said lower gear is larger a torque on said upper gear.

5. The manufacturing system of absorbent product according to claim 1, wherein said accumulating apparatus is not provided with an actuator for moving said upper arm and said lower arm toward and away from each other.

* * * * *